US008936698B2

(12) United States Patent
Karppi et al.

(10) Patent No.: US 8,936,698 B2
(45) Date of Patent: Jan. 20, 2015

(54) FIXATIVE COMPOSITION, THICK STOCK COMPOSITION AND PROCESS FOR FIXATING HYDROPHOBIC AND/OR ANIONIC SUBSTANCES ON FIBRES

(75) Inventors: Asko Karppi, Turku (FI); Lenita Lindberg, Siuntio (FI); Matti Hietaniemi, Espoo (FI)

(73) Assignee: Kemira, Oyj, Helsinki (FI)

( * ) Notice: Subject to any disclaimer, the term of this patent is extended or adjusted under 35 U.S.C. 154(b) by 0 days.

(21) Appl. No.: 14/126,658

(22) PCT Filed: Jun. 29, 2012

(86) PCT No.: PCT/FI2012/050686

§ 371 (c)(1),
(2), (4) Date: Dec. 16, 2013

(87) PCT Pub. No.: WO2013/001169

PCT Pub. Date: Jan. 3, 2013

(65) Prior Publication Data

US 2014/0110073 A1 Apr. 24, 2014

(30) Foreign Application Priority Data

Jun. 30, 2011 (FI) ..... 20115690

(51) Int. Cl.
*D21H 11/00* (2006.01)

(52) U.S. Cl.
USPC ..... 162/164.3

(58) Field of Classification Search
USPC ..... 162/164.3, 175, 158, 190, 199, 164, 162/168
See application file for complete search history.

(56) References Cited

U.S. PATENT DOCUMENTS

| | | | |
|---|---|---|---|
| 5,578,169 | A | 11/1996 | Vihervaara |
| 6,303,002 | B1 | 10/2001 | Linhart et al. |
| 6,616,807 | B1 * | 9/2003 | Dyllick-Brenzinger et al. ..... 162/175 |
| 2004/0112559 | A1 | 6/2004 | Du Bourg et al. |
| 2004/0231816 | A1 | 11/2004 | Steeg et al. |

FOREIGN PATENT DOCUMENTS

| | | | |
|---|---|---|---|
| DE | 19713755 | | 8/1998 |
| DE | 19715832 | A1 | 10/1998 |
| EP | 2192228 | A1 | 6/2010 |
| WO | 9310305 | A1 | 5/1993 |
| WO | 0171092 | A2 | 9/2001 |
| WO | 2009043971 | A1 | 4/2009 |
| WO | 2011015297 | A1 | 2/2011 |

OTHER PUBLICATIONS

The International Search Report and Written Opinion dated Oct. 26, 2012.
The Finnish Search Report dated May 3, 2012.

* cited by examiner

*Primary Examiner* — Mark Halpern
(74) *Attorney, Agent, or Firm* — Thomas Horstemeyer, LLP

(57) ABSTRACT

The present invention relates to a fixative composition and process for reducing hydrophobic and/or anionic substances in fiber-containing stock for making of paper, board or the like. The composition comprises a synthetic cationic polymer, which has a charge density of 3.0-24 meq/g, and a cationic non-degraded starch, which has charge density of 0.5-3.0 meq/g. The invention relates also to thick stock composition comprising fibers and a fixative composition according to the invention.

16 Claims, No Drawings

FIXATIVE COMPOSITION, THICK STOCK COMPOSITION AND PROCESS FOR FIXATING HYDROPHOBIC AND/OR ANIONIC SUBSTANCES ON FIBRES

CROSS REFERENCE TO RELATED APPLICATION

This application is the 35 U.S.C. §371 national stage of PCT application entitled "Fixative Composition, Thick Stock Composition and Process for Fixating Hydrophobic and/or Anionic Substances on Fibres," having serial number PCT/FI2012/050686, filed on 29 Jun. 2012, which claims priority to Finland Application No. 20115690, filing date Jun. 30, 2011, each incorporated by reference in their entireties.

FIELD OF THE INVENTION

The present invention relates to a fixative composition and process for fixating hydrophobic and/or anionic substances on fibres in making of paper, board or the like according to the preambles of the enclosed claims. The invention relates also to a thick stock composition.

BACKGROUND

Good runnability of a paper machine is one of the key issues in paper making. It is important to control the wet end of a paper or board machine in order to minimise the amount of web breaks and the need for washing shutdowns due to dirt build-up in the process system.

One reason for web breaks and dirt build-up is the agglomeration of hydrophobic particles in the paper making stock and white water system. Especially paper stocks comprising mechanical pulps, such as thermomechanical pulp (TMP) or groundwood pulp comprise high amounts of hydrophobic material, which originates from wood pitch. Wood pitch substances are insoluble in water and they exist in the stock as colloids or particles with anionic surface charge. Typical substances in mechanical stocks are, for example, fatty and resin acids, different sterols and their derivatives.

On the other hand, coated broke, irrespectively of the origin of the pulp, may contain hydrophobic anionic material, which originates from e.g. used binder substances, such as latexes. Such hydrophobic material is called "white pitch". Also recycled fibre stocks such as de-inked pulp (DIP) and old corrugated container (OCC) pulp may contain hydrophobic substances, which easily agglomerate and cause deposits. Such hydrophobic substances are usually adhesive based and they are commonly called as stickies. Stickies, which have particle size more than about 100 μm are typically removed from the stock mechanically, e.g. by screening or by flotation. Stickies, which have particle size less than about 100 μm are called microstickies and they are potential source for agglomeration, deposits, web breaks and dirt build-up. Microstickies are not easily removed mechanically from the stock, but other measures are needed.

Closing of the water systems of the paper making machines and increased water recirculation may increase the concentration of hydrophobic anionic substances and/or stickies. Increased concentration of these substances may lead to an increase in particle size of hydrophobic substances by agglomeration. Increased concentration and increased particle size of the hydrophobic substances and/or stickies may easily cause formation of deposits on hot surfaces in the paper making machine. Hydrophobic substances and/or stickies may also block felts, whereby the production speed of the paper machine decreases. They may also result in spots in the final paper or board, leading to improper product quality.

Different chemical agents, usually called deposit control agents, have been developed for avoiding or decreasing the unwanted effects of hydrophobic anionic substances in the paper making process. Deposit control agents are widely used in order to avoid formation of deposits, which may cause web breaks and dirt build-up, to maintain good runnability of a paper making machine, and to keep the final product on acceptable quality level.

Various chemical strategies are employed in deposit control, for example, use of fixatives, dispersing agents or anti-tackifying agents. Fixatives for deposit control of a paper making stock are typically polymeric substances having a cationic charge, i.e. cationic polymers.

Cationic polymers react with hydrophobic and anionic colloids and particles in a manner of polyelectrolyte complexation. Cationic polymers can form agglomerates with dissolved and colloidal substances and attach them onto fibres, fillers and fines in the paper stock. An excess cationic charge in the cationic polymer is preferred to fix the hydrophobic material on the fibres after the formation of the polyelectrolyte complex. This phenomenon is called fixation.

Cationic synthetic polymers are typically used as fixatives. They are usually polymers with low molecular weight and high cationic charge density, such as copolymers of dialkylamines and epichlorohydrin, poly-diallyldimethylammonium chloride (p-DADMAC), poly-ethyleneimine and polyvinylamine. Cationic synthetic polymers, which are used as fixing agents, are typically produced from oil based chemicals and raw materials. They are usually expensive, and not always environmentally advantageous.

Cationic polysaccharides, such as high cationic starches, are used as fixatives. Starches with a high molecular weight (MW) average are typically highly viscous, which complicates their use for industrial purposes.

WO 93/10305 discloses a method for reducing the amount of interfering substances in the water circulation of a process involving wood-based fibre suspensions by binding the interfering substances to the fibres by means of cationic starch with a charge density of 1.5-3.5 meq/g. Starch is used alone without any other fixative agents.

EP 2192228 discloses use of cationic starches having a cationic degree of substitution over 0.2 to 1.0 and a molecular weight average over 30,000,000 Dalton as a fixing agents in making of paper or paperboard.

One object of this invention is to minimise or even eliminate the disadvantages in the prior art.

One object of the invention is also to provide a fixative composition that has improved efficiency and is simple to use.

A further object of this invention is to provide a process for effectively decreasing the amount of hydrophobic and/or anionic substances in stock for making of paper or board.

These objects are attained with a method and an arrangement having the characteristics presented below in the characterising parts of the independent claims.

Typical fixative composition according to the present invention for reducing hydrophobic and/or anionic substances in fibre-containing stock for making of paper, board or the like, comprises

- a synthetic cationic polymer, which has a charge density of 3.0-24 meq/g, and
- a cationic non-degraded starch, which has a charge density of 0.5-3.0 meq/g.

Typical thick stock composition according to the present invention for making of paper, board or the like, comprises

- fibres, and
- a fixative composition according to the present invention.

Typical process according to the present invention for fixating hydrophobic and/or anionic substances on fibres in making of paper, board or the like, comprises obtaining a thick stock composition with consistency >20 g/l, and adding to the thick stock composition a synthetic cationic polymer, which has a charge density 3.0-24 meq/g and a cationic non-degraded starch, which has a charge density of 0.5-3.0 meq/g.

All the described embodiments and advantages apply both for the compositions and the process according to the present invention, when applicable, even if not always explicitly stated so.

Now it has surprisingly been found out that an addition of fully synthetic cationic polymer with a high charge density together with a cationic non-degraded starch with high charge density to the thick stock provides unexpected synergistic advantages in comparison to the addition of cationic polymer or starch alone. It has been observed that the fixation of the hydrophobic anionic particles on the fibre surfaces in the paper making stock is significantly enhanced, beyond any expectations, which are based on the behaviour of the separate single components of the composition with the same total dosage level. It has been observed that the reduction in turbidity and/or in the cationic demand is drastically improved when the composition according the invention is used, which might be considered surprising because the charge density of fully synthetic polymers is higher than the charge density of cationic native starches or its mixtures.

The present invention provides also economic and environmental advantages, as a large part of the synthetic cationic polymer may be replaced by cationic non-degraded starch. Cationic starch originates from renewable natural sources, and is more environmentally friendly than fully synthetic cationic polymers. In addition cationic non-degraded starch is usually less expensive than synthetic cationic polymers, and thus their use is economically feasible.

The theoretical background of the phenomenon is not yet fully understood. It may be speculated, without wishing to be bound by a theory that hydrophobic and/or anionic substances with varying particle sizes exist in the fibre-containing stock. It is also possible that there exists variation in the surface charge densities of hydrophobic and/or anionic substances. Combination according to the present invention of fully synthetic cationic polymer and cationic non-degraded starch provides for improved formation of polyelectrolyte complexes with various hydrophobic and/or anionic substances, which consequently leads to improved fixation efficiency. The synthetic polymer and non-degraded starch have different molecular sizes, different backbone structures and different charge densities, which enables effective interaction with various hydrophobic and/or anionic substances. Use of the present invention decreases cationic demand of the fibrous stock, whereby it is assumed that the composition decreases the cationic demand of the fibrous stock more than only by charge neutralization.

In the context of the present application the term "cationic non-degraded starch" means starch which have been modified solely by cationisation. It is non-degraded and non-cross-linked. Cationic non-degraded starch is of natural origin.

In the context of the present application the terms "fixative" or "fixing agent" are used interchangeably. They denote compounds or compositions that cause pitch, dissolved and colloidal substances, anionic trash or the like, while still in fine dispersed state, to be deposited onto the fibres, fillers and/or fines in the stock and to prevent their accumulation in the suspension and/or deposition on the paper or paper making machinery. Fixation of hydrophobic and/or anionic substances onto the fibres should not be mixed with retention or dewatering, which are clearly different phenomenon. Fixation is basically flock-free process, i.e. no extensive flocculation can be observed. In retention, on the other hand, flocculant chemicals are used to bind filler and fines to flocks, which contain fibres in order to retain them in paper web rather than let them run through the paper machine wire to water circulation. Flocculation chemicals, which are used in retention purposes, comprise cationic or anionic charge and they are typically high molecular weight cationic polyacrylamides. Molecular sizes of such polyacrylamides are typically 4,000,000-20,000,000 Dalton. The charge density of flocculation chemicals used in retention is typically low or moderate, typically 0.4-2.5 meq/g, more typically 0.8-1.8 meq/g.

According to the invention the synthetic cationic polymer and the cationic non-degraded starch are added to the thick stock composition in order to improve the fixation of anionic material, such as pitch in chemical and mechanical pulps, stickies in recycled fibres and white pitch in coated broke, to the fibres. In the context of this application thick stock is understood as a fibrous stock, which has consistency of at least 20 g/l, preferably more than 25 g/l, more preferably more than 30 g/l. Preferably the addition of the synthetic cationic polymer and the cationic non-degraded starch is located after the stock storage towers, but before thick stock is diluted in the wire pit (off-machine silo) with short loop white water. The fixative composition may comprise 20-80 weight-% synthetic cationic polymer and 20-80 weight-% of cationic non-degraded starch. According to one preferred embodiment the fixative composition may comprise 20-70 weight-% synthetic cationic polymer and 30-80 weight-% cationic non-degraded starch, or more preferably 30-60 weight-% synthetic cationic polymer and 40-70 weight-% cationic non-degraded starch. Preferably the amount of cationic non-degraded starch is equal or higher than the amount of synthetic cationic polymer in the fixative composition. According to one embodiment of the invention the fixative composition may comprise 30-50 weight-% synthetic cationic polymer and 50-70 weight-% cationic non-degraded starch. A high proportion of cationic non-degraded starch in the composition is preferred for cost efficiency and environmental reasons.

According to one embodiment of the invention the synthetic cationic polymer is a copolymer of dialkylamine(s) and epichlorohydrin, such as a copolymer of dimethylamine and/or diethylamine and epichlorohydrin. The co-polymer of dialkylamine(s) and epichlorohydrin may be linear or cross-linked. According to other embodiment of the invention the synthetic cationic polymer is poly-DADMAC, polyethyleneimine or polyvinylamine. Preferably the synthetic cationic polymer is a copolymer of dimethylamine and epichlorohydrin, either linear or cross-linked. The cross-linker of the polymer may be alkylenediamine, dialkylene triamine or the like. More preferably the synthetic cationic polymer is a copolymer of dimethylamine and epichlorohydrin, cross-linked with ethylenediamine. According to one embodiment of the synthetic cationic polymer comprises about equimolar amounts of epichlorohydrin and dimethylamine, and 0.2-3 mol-% of ethylenediamine as crosslinker agent.

The synthetic cationic polymer has normally a charge density of 3-23 meq/g, preferably 3-10 meq/g, more preferably 4-8 meq/g. The synthetic cationic polymer has preferably an average MW in the range of 20,000-1,500,000 Dalton, more preferably 30,000-1,000,000 Dalton, the most preferably 40,000-500,000 Dalton.

Cationic non-degraded starch that may be used in the present invention is any cationic non-degraded starch having the defined charge density. Suitable starches are, for example, potato, rice, corn, waxy corn, wheat, barley, sweet potato or tapioca starch, potato starch being preferred. Suitable starches preferably have an amylopectin content >70%, preferably >75%. A suitable starch may have, for example, an amylopectin content of 70-100%, preferably 75-98%. According to one embodiment of the invention, starch has an amylopectin content >85%, typically 85-100%, preferably >85%. According to another embodiment of the invention the starch may be conventional botanic starch, for example potato starch, with an amylopectin content of 70-85%.

Starch may be cationised by any suitable method. Preferably starch is cationised by using 2,3-epoxypropyltrimethylammonium chloride or 3-chloro-2-hydroxypropyltrimethylammonium chloride, 2,3-epoxypropyltrimethylammonium chloride being preferred. It is also possible to cationise starch by using cationic acrylamide derivatives, such as (3-acrylamidopropyl)-trimethylammonium chloride.

Cationicity of cationic starch may be defined by using degree of substitution (DS) or charge density (CD).

Degree of substitution defines how many substituted groups are contained in cationic starch, calculated per one anhydroglucose unit of starch. Degree of substitution of cationic starch, which is cationised with 2,3-epoxypropyltrimethylammonium chloride, is typically calculated by using the nitrogen content of pure dry cationic starch, which does not contain any other nitrogen sources than the quaternary ammonium groups. Nitrogen content is typically determined by using commonly known Kjeldahl-method. Degree of substitution of cationic starch, which is cationised with 2,3-epoxypropyltrimethylammonium chloride may be calculated by using the following equation:

$$DS=(162\times N\text{-}\%)/(1400-(N\text{-}\%\times 151.6),$$

where 162 is the molecular weight of an anhydroglucose unit (AHG), N-% is the nitrogen value in %, 1400 is the molecular weight of nitrogen multiplied by 100 and 151.5 is the molecular weight of 2,3-epoxypropyltrimethylammonium chloride.

According to one embodiment the cationic non-degraded starch has a degree of substitution, DS, from about 0.09 to 0.9, preferably from about 0.1 to 0.7, more preferably from about 0.13 to 0.5.

Charge density of cationic starch may also be defined by nitrogen content of pure dry cationic starch, which does not contain any other nitrogen sources than quaternary ammonium groups. Charge density is calculated by using the equation:

$$CD=(N\text{-}\%\times 10)/14$$

and the result is given as meq/g. Charge density of cationic starch depends on the weight amount of quaternary ammonium groups in cationic starch. Thus, for example, cationic starch which is cationised with 2,3-epoxypropyltrimethylammonium chloride and has a nitrogen content of 1.46 weight-%, has degree of substitution of 0.20 and charge density of 1.04 meq/g. Correspondingly, cationic starch which is cationised with glycidylammonium chloride and has a nitrogen content 2.5 weight-% has degree of substitution of 0.40 and charge density of 1.8 meq/g.

According to one preferred embodiment of the present invention the cationic starch has a charge density of 0.5-2.5 meq/g, preferably 0.6-2.5 meq/g, more preferably 0.7-2.0 meq/g.

Cationic starches, which have been cationised with other cationisation agents than 2,3-epoxypropyltrimethylammonium chloride, such as (3-acrylamidopropyl)-trimethylammonium chloride, have different conversion rates between the charge density and the degree of substitution than presented in the examples of the present application.

The fixative composition, comprising both a synthetic cationic polymer and a cationic non-degraded starch, may have a total charge density in the range of 1.5-19 meq/g, preferably 2-8 meq/g. According to one preferable embodiment of the present invention the fixative composition is prepared by mixing a cationic non-degraded starch, which has charge density of 0.5-2.0 meq/g, with synthetic cationic polymer, which has charge density of 4-23 meq/g.

According to one preferred embodiment of the invention the cationic starch is starch, where at least 75 weight-% of the starch material has an average molecular weight (MW) over 30,000,000 Dalton, preferably over 40,000,000 Dalton. The backbone of the starch is preferably not degraded or not cross-linked.

Suitable cationic non-degraded starches are disclosed for example in EP 2192228. Some cationic non-degraded starches having suitable properties are also disclosed in GB 2063282, or in article by Hellwig et al.: Production of Cationic Starch Ethers Using an Improved Dry Process, Starch/Stärke 44 (1992) 69-74.

The fixative composition according to one embodiment of the invention has typically a viscosity of 200-10,000 mPas, preferably 300-6000 mPas, more preferably 400-4000 mPas, measured at 23° C. with Brookfield RVDV viscometer with 100 rpm. The spindle is selected according to the viscosity level, spindle 2 for 100-400 mPas, spindle 3 for 400-1000 mPas, spindle 4 for 1000-2000 mPas, spindle 5 for 2000-4000 mPas and spindle 6 for 4000-10000 mPas. In practice, the viscosity measurement is carried out by choosing the spindle with lowest spindle number from 2 to 7, with which the viscosity can be measured. If the chosen spindle is too large, the measurement yields no results.

Thick stock according to the present invention which is intended for making of paper, board or the like may comprise any type of short or long fibre chemical pulp, for instance pulps made with the sulphite or sulphate (Kraft) process. According to one preferred embodiment of the invention the fibres originate from mechanical pulp, coated broke and/or recycled pulp. Mechanical pulp comprises fibres originating from mechanical pulping, comprising both partial or totally mechanical pulping processes, such as stone ground wood (SGW) pulping, thermomechanical pulping (TMP), chemithermomechanical pulping (CTMP), bleached chemithermomechanical pulping (BCTMP) and pressurised ground wood (PGW) pulping. Recycled pulp comprises fibres originating from resuspended paper or paperboard product, such as untreated waste paper, any type of broke, old corrugated container (OCC) pulp or deinked recycled pulp (DIP).

Fibres in the thick stock may originate up to 100 weight-% from recycled fibres and/or mechanical fibres. In some embodiments the pulp used in thick stock for making of paper or board may be formed of entirely of one or more of the aforementioned mechanical pulps.

Cationic synthetic polymer and cationic non-degraded starch may be dosed or added separately from each other to the thick stock composition. The cationic synthetic polymer and cationic starch may be added to the thick stock simultaneously but separately, or they may be added separately one after another. When the cationic synthetic polymer and cationic non-degraded starch are dosed or added separately from each other, it is possible to dose or add them to separate flows of thick stock material, which are then combined to form a single thick stock composition. For example, the cationic synthetic polymer may be added to groundwood flow and the cationic non-degraded starch may be added to the mixing chest or machine chest, as long as the consistency of the thick stock is at least 2%. According to one embodiment of the invention the synthetic cationic polymer is added to the thick stock before adding the cationic non-degraded starch to the thick stock.

The synthetic cationic polymer solution may be preferably mixed together with cationic non-degraded starch solution before the addition of the resulting composition to the thick stock. Cationised non-degraded starch shows normally a high viscosity value in dissolved form, which is problematic for commercial purposes. Mixing the cationic native non-degraded starch solution with cationic synthetic polymer solution lowers the viscosity value, making the handling and the use of the resulting mixture more convenient.

Preferably, no particulate material is added to the thick stock before or after the addition of the fixative composition or its constituents.

According to one embodiment of the invention the fixative composition may be dosed to the thick stock typically in amount of 100-1500 g/ton, more typically 200-1500 g/ton, even more typically 500-1500 g/ton, sometimes even in amount >1500 g/ton.

All percentage values in this application, both in description and experimental part, are given in weight-%, if not otherwise stated.

EXPERIMENTAL SECTION

The following non-limiting examples illustrate some embodiments of the present invention.

Example 1

Production of High Cationic Starch

High cationic starch is produced by mixing 23.7 g commercial aqueous 2,3-epoxypropyltrimethylammonium chloride (GMAC) product comprising 72.2% 2,3-epoxypropyltrimethylammonium chloride and 1.8% 3-chloro-2-hydroxypropyltrimethylammonium chloride with 89.7 g water. Into the obtained GMAC/water solution is added by mixing 100.0 g 82 weight-% native amylopectin potato starch. The resulting mixture is cooled to 15° C. in an ice-water bath under simultaneous agitation with a mechanical mixer. 3.30 g of 40 weight-% NaOH solution is dosed dropwise to the mixture comprising starch, GMAC and water. After the addition of NaOH, the mixture is heated to 30° C. and then transferred into a plastic bottle. The bottle is placed into a plate shaker and shaked at 30° C. for 24 h and then immediately afterwards at 35° C. for 72 h. A high cationic starch is obtained.

10 g of the prepared high cationic starch is taken for analysis of bound nitrogen. The starch sample is mixed with 300 ml of 90 weight-% aqueous ethanol and agitated with Ystral X 1020 stirrer for 20 min, whereby a precipitate is formed. The precipitate is collected by filtration. The collected precipitate is washed two times by mixing it with 300 ml of 90 weight-% ethanol, agitated with Ystral-mixer for 20 min. The washed precipitate is collected and dried in an oven at 115° C. for 4 h. Nitrogen content of the washed starch precipitate is determined by Kjeldahl method. Nitrogen content of the washed and dried cationised starch is 1.43%. Charge density of the cationic starch is thus 1.0 meq/g.

High cationic starch is dissolved in the following manner: 150 g of obtained high cationic starch is dosed continuously during 2 h into 200 g water under mixing with Diaf-mixer at maximum speed. The obtained starch solution is neutralised with 25 weight-% sulphuric acid to pH 6.8. Dry substance content of the dissolved high cationic starch solution is determined by drying a starch solution sample of 3.0 g in an aluminium cup in an oven at 115° C. for 4 h. Dry substance content of the starch solution is 20.9%. Viscosity is measured with Brookfield RVDV II-viscometer at 23° C. with spindle 6, 100 rpm. Viscosity value is 5050 mPas.

Example 2

Production of Fixative Composition Comprising High Cationic Starch and a Synthetic Cationic Polymer A commercial copolymer of epichlorohydrin and dimethylamine, crosslinked with ethylenediamine, and having a dry substance content of 50.1%, charge density 7.3 meq/g, viscosity 630 mPas (measured with Brookfield RVDV II viscometer, spindle 3, 100 rpm, at 23° C.), and pH value 5.6, is used as starting material. 300 g cationic starch solution from Example 1 (dry substance content 20.9%, charge density 1.0 meq/g, viscosity 5050 mPas, pH 6.8) is mixed with 125 g said commercial copolymer and 205 g de-ionized water under agitation with Diaf-mixer for 30 min with maximum speed. A fixative composition is thus obtained that contains 50 weight-% of cationic starch and 50 weight-% of synthetic cationic polymer. The obtained fixative composition has dry substance content 20.0%, charge density 4.1 meg/g, viscosity value 530 mPas (measured with Brookfield RVDV II-viscometer at 23° C. with spindle 3, 100 rpm) and pH 5.7.

Example 3

General Procedure for Fixation Tests

Technical performance of the fixative composition obtained in Example 2 is tested with thick stock fixation test. Copolymer of epichlorohydrin and dimethylamine, crosslinked with ethylene diamine is used as a reference for synthetic cationic polymer, cationic amylopectin potato starch made in Example 1 is used as a reference for cationic starch.

The fixation test is done according to the following procedure:

Test stock is a thick stock with consistency at least 30 g/l. If the consistency of the original thick stock is so high that a feasible handling, such as mixing, is not possible, then the stock is diluted to a minimum consistency of 30 g/l with clear process water filtrate of from the stock. Temperature in the fixation tests is 45° C.

The chemicals to be tested, i.e. fixative composition according to the present invention, reference starch and reference polymer are dosed into thick stock. All used chemicals are first diluted to a concentration of 0.05 weight-%. 100 g thick stock sample is placed into a beaker, for each chemical to be tested. Thick stock sample is agitated with 500 rpm with mechanical stirrer. Diluted chemical is added to the thick stock sample and agitation is continued for 15 seconds. The stock is then allowed to filter through a filter paper (Whatman 589/1 black-ribbon) by gravity until no filtrate is drained. The filtrate is collected. Turbidity and charge density are measured from the filtrate. Turbidity and charge density changes compared to value of untreated reference stock are calculated.

Fixation Test 1: Using Coated Broke as Test Stock

Test stock in the fixation test 1 is coated broke. Parameters of the coated broke, before any addition of fixation chemicals, are as follows:

Consistency: 49.1 g/l
Ash content of dry pulp: 36.0%
Zeta-potential: −20.5 mV
Conductivity: 2.23 mS/cm
pH: 7.4
Charge density of the filtrate: −190.9 μeq/l
Turbidity of the filtrate: 5837 NTU The parameters of the test stock are determined by using following methods and devices:

Consistency: international standard ISO 4119:1995
Ash content: international standard ISO 1762:2001
Zeta-potential: Mütek SZP-06 system zeta potential apparatus by BTG
Conductivity: Knick conductivity meter, model 911 Cond.
Charge density: Mütek PDC 04 particle charge detector by BTG equipped with
Mettler DL 25 titrator, using 0.001 N poly-DADMAC as titrant polymer, supplied by BTG.
Turbidity: WTW Turb 555 IR turbidity meter.

The thick stock is used as such without any dilution. The chemicals in the test are:

1. High cationic starch of Example 1, named "HCS"
2. Commercial synthetic copolymer, used in Example 2, named "Polyamine"
3. Fixative composition prepared in Example 2, comprising both high cationic starch and synthetic cationic polymer named "FC"

The results of the fixation test are presented in Table 1. The dosage values are given as dosage of active chemical.

TABLE 1

Fixation test results for coated broke.

| Fixative chemical | Dosage, g/t pulp | Reduction of turbidity, % | Charge density increase, % |
|---|---|---|---|
| HCS | 400 | 9 | 12 |
| HCS | 800 | 61 | 32 |
| HCS | 1600 | 95 | 43 |
| Polyamine | 400 | 60 | 20 |
| Polyamine | 800 | 93 | 41 |
| Polyamine | 1600 | 99 | 54 |
| FC | 400 | 90 | 29 |
| FC | 800 | 99 | 41 |
| FC | 1600 | 100 | 68 |

It can be observed that the fixative composition yields clearly better results than either the cationic starch or synthetic cationic polymer alone, when they are used separately from each other. It should be remembered that the fixative composition ("FC") is 50/50 mixture of high cationic starch and synthetic cationic polymer. Thus, for example, at dosage level 400 g/(ton pulp) the mixture comprises 200 g/(ton pulp) of high cationic starch and 200 g/(ton pulp) of synthetic cationic polymer. It can be seen from Table 1 that the results obtained by using fixative composition ("FC") according to the present invention are much better than results that are obtained by using larger separate dosages of cationic starch or cationic polymer.

Theoretical turbidity reduction and charge density increase values may be calculated for evaluation of the expected turbidity reduction and charge density increase based on the separate performances of high cationic starch and synthetic cationic polymer. This theoretical value is calculated by adding together the separate turbidity reduction values obtained at certain high cationic starch ("HSC") dosage and at the same synthetic cationic polymer ("Polyamine") dosage. This sum is then divided by 2 in order to take into account the proper dosage amount, and the theoretical expected value is obtained. These theoretical values are shown in Table 2.

TABLE 2

Calculated theoretical values for reduction in turbidity and charge density increase for coated broke.

| Fixative chemical | Dosage, g/t pulp | Reduction of turbidity, % | Charge density increase, % |
|---|---|---|---|
| (HCS + Polyamine)/2 | 400 | 34 | 16 |
| (HCS + Polyamine)/2 | 800 | 77 | 36 |
| (HCS + Polyamine)/2 | 1600 | 97 | 49 |

The calculated theoretical values describe the effect which may be expected to be achieved by dosage of both cationic starch and cationic polymer without any synergetic effect. If these theoretical values are compared to the real values at the same dosage levels, which are obtained by using fixative composition "FC" and shown in Table 1, the synergetic effect which is obtained by the present invention is clearly observable. Fixative composition ("FC") reduces turbidity and increases charge density of the filtrate in efficient manner.

Fixation Test 2: Using De-inked Pulp (DIP) as Test Stock

Test stock in the Fixation Test 2 is de-inked pulp. The stock is diluted to suitable consistency with a clear filtrate from the stock. Parameters of the diluted de-inked pulp, before any addition of fixation chemicals, are as follows:

Consistency: 30.5 g/l
Ash content of dry pulp: 15.4%
Zeta-potential: −18.0 mV
Conductivity: 1.89 mS/cm
pH: 7.7
Charge density of the filtrate: −141.5 μeq/l
Turbidity of the filtrate: 2525 NTU Same test standards and devices are used as in Fixation Test 1.

The chemicals are the same as in the Fixation Test 1:

1. High cationic starch of Example 1, named "HCS"
2. Commercial Synthetic copolymer, used in Example 2, named "Polyamine"
3. Fixative composition prepared in Example 2, comprising both high cationic starch and synthetic cationic polymer named "FC"

The results of Fixation Test 2 are presented in Table 3. The dosage values are given as dosage of active chemical.

TABLE 3

Fixation test results for de-inked pulp.

| Fixative chemical | Dosage, g/t pulp | Reduction of turbidity, % | Charge density increase, % |
|---|---|---|---|
| HCS | 200 | 8 | 17 |
| HCS | 400 | 22 | 22 |
| HCS | 800 | 54 | 38 |
| Polyamine | 200 | 74 | 39 |
| Polyamine | 400 | 92 | 56 |
| Polyamine | 800 | 98 | 69 |
| FC | 200 | 62 | 29 |
| FC | 400 | 81 | 45 |
| FC | 800 | 95 | 54 |

It can be observed from Table 3 that by using the fixative composition ("FC") according to the present invention it is possible to achieve similar turbidity reduction and charge density increase values than by using synthetic cationic polymer alone at double dosage.

As in Fixation Test 1, theoretical turbidity decrease and charge density increase values are calculated in the same manner. These theoretical values are shown in Table 4.

TABLE 4

Calculated theoretical values for reduction in turbidity and charge density increase for de-inked pulp.

| Fixative chemical | Dosage, g/t pulp | Reduction of turbidity, % | Charge density increase, % |
|---|---|---|---|
| (HCS + Polyamine)/2 | 200 | 41 | 28 |
| (HCS + Polyamine)/2 | 400 | 57 | 39 |
| (HCS + Polyamine)/2 | 800 | 76 | 53 |

When the theoretical values in Table 4 are compared to the real values at the same dosage levels, which are obtained by using fixative composition ("FC") and shown in Table 3, the synergetic effect which is obtained by the present invention is again clearly observable. Fixative composition ("FC") reduces turbidity and increases charge density of the filtrate in efficient manner.

Fixation Test 3: Using Thermomechanical Pulp (TMP) as Test Stock

Test stock in the Fixation Test 3 is thermomechanical pulp. The stock is diluted to suitable consistency with a clear filtrate from the stock. Parameters of the diluted thermomechanical pulp, before any addition of fixation chemicals, are as follows:

Consistency: 31.0 g/l
Ash content of dry pulp: 7.4%
Zeta-potential: −14.5 mV
Conductivity: 1.12 mS/cm
pH: 5.2
Charge density of the filtrate: −225.4 μeq/l
Turbidity of the filtrate: 548 NTU Same test standards and devices are used as in Fixation Tests 1 and 2.

The chemicals are the same as in the Fixation Test 1 and 2:

1. High cationic starch of Example 1, named "HCS"
2. Commercial Synthetic copolymer, used in Example 2, named "Polyamine"
3. Fixative composition prepared in Example 2, comprising both high cationic starch and synthetic cationic polymer named "FC"

The results of the Fixation Test 3 are presented in Table 5. The dosage values are given as dosage of active chemical.

TABLE 5

Fixation test results for thermomechanical pulp.

| Fixative chemical | Dosage, g/t pulp | Reduction of turbidity, % | Charge density increase, % |
|---|---|---|---|
| HCS | 200 | 34 | 5 |
| HCS | 400 | 56 | 13 |
| HCS | 800 | 81 | 21 |
| HCS | 1600 | 98 | 19 |
| Polyamine | 200 | 28 | 14 |
| Polyamine | 400 | 63 | 25 |
| Polyamine | 800 | 89 | 36 |
| Polyamine | 1600 | 97 | 56 |
| FC | 200 | 39 | 16 |
| FC | 400 | 64 | 21 |
| FC | 800 | 88 | 33 |
| FC | 1600 | 98 | 54 |

It can be observed that the fixative composition yields clearly better results than either the cationic starch or synthetic cationic polymer alone, when they are used separately from each other. The results obtained by using fixative composition ("FC") according to the present invention are generally better than results that are obtained by using larger separate dosages of cationic starch or cationic polymer.

As in Fixation Tests 1 and 2, theoretical turbidity decrease and charge density increase values are calculated in the same manner. These theoretical values are shown in Table 6.

TABLE 6

Calculated theoretical values for reduction in turbidity and charge density increase for thermomechanical pulp.

| Fixative chemical | Dosage, g/t pulp | Reduction of turbidity, % | Charge density increase, % |
|---|---|---|---|
| (HCS + Polyamine)/2 | 200 | 31 | 10 |
| (HCS + Polyamine)/2 | 400 | 60 | 19 |
| (HCS + Polyamine)/2 | 800 | 85 | 28 |
| (HCS + Polyamine)/2 | 1600 | 98 | 38 |

When the theoretical values in Table 6 are compared to the real values at the same dosage levels, which are obtained by using fixative composition ("FC") and shown in Table 5, the synergetic effect which is obtained by the present invention is again clearly observable. Fixative composition ("FC") reduces turbidity and increases charge density of the filtrate in efficient manner.

Example 4

Production of Fixative Composition 2 (FC2) Comprising High Cationic Starch and a Synthetic Cationic Polymer Conventional cationic potato starch, which has bound nitrogen content of 1.56%, i.e. having a degree of substitution, DS, 0.22, and dry substance content 89.8% is dissolved in water by using the following procedure:

1555 g de-ionized water is placed in a reactor equipped with a heating jacket and mechanical Diaf-agitator and heated to 90° C. 445 g of cationic potato starch is dosed continuously during 60 min into water, while mixing with 1500 rpm. After dosage of the starch, the mixture is mixed for another 30 min. The amount of evaporated water is replaced with de-ionized water. The solution is mixed further for 2 min with Kady LT 2000 rotor-stator high speed dispersion lab mill, using about 60% of the maximum speed at the temperature about 95-100° C. The evaporated water is replaced with deionized water. The solution is cooled to room temperature. The solution has dry solids content of 20.0%, viscosity 4450 mPas and pH 6.5.

The Fixative Composition 2 is obtained by mixing of 200 g of this dissolved cationic potato starch solution with 119.5 g de-ionized water and 80.5 g of commercial copolymer of epichlorohydrin and dimethylamine, crosslinked with ethylenediamine, having dry substance content of 49.7%; viscosity of 770 mPas; pH 4.9; charge density 7.2 meq/g dry product, determined by Mutek at pH 3; and. The mixture is mixed for 15 min at room temperature with Diaf-mixer by 1500 rpm. Evaporated water is replaced with de-ionized water. The obtained solution of Fixative Composition 2 has dry substance content of 20.0%; viscosity of 510 mPas, measured with Brookfield DV I+−viscometer, equipped with SSA with spindle 18, rotation speed 6 rpm; and pH 5.3.

Fixation Test A: Using Thermomechanical Pulp (TMP) as Test Stock

Test stock in the fixation test A is a thermo mechanical pulp. Parameters of the thermo mechanical pulp, before any addition of fixation chemicals, are as follows:

Consistency: 25.4 g/l

Ash content of dry pulp: 0.7%

Zeta-potential: −10.3 mV

Conductivity: 0.87 mS/cm pH: 7.6

Charge density of the filtrate: −377.9 μeq/l

Turbidity of the filtrate: 317 NTU

Same test standards and devices are used as in Fixation Test 1.

The chemicals in the test are:

1. Commercial poly-DADMAC
2. Commercial synthetic copolymer, used in Example 2, named "Polyamine"
3. Commercial synthetic copolymer polyethyleneimine, named "PEI"
4. Fixative composition 2, comprising both high cationic starch and synthetic cationic polymer named "FC2"

TABLE 7

Fixation test results for thermomechanical pulp.

| Fixative chemical | Dosage, g/t pulp | Reduction of turbidity, % | Charge density increase, % |
|---|---|---|---|
| p-DADMAC | 100 | 5 | 5 |
| p-DADMAC | 200 | 9 | 11 |
| p-DADMAC | 400 | 32 | 20 |
| Polyamine | 100 | 3 | 1 |
| Polyamine | 200 | 7 | 11 |
| Polyamine | 400 | 21 | 16 |
| PEI | 100 | 1 | 0 |
| PEI | 200 | 3 | 7 |
| PEI | 400 | 8 | 13 |
| FC2 | 100 | 12 | 3 |
| FC2 | 200 | 27 | −1 |
| FC2 | 400 | 51 | 9 |

The results in Table 7 show that the Fixative Composition 2 ("FC2"), which contains high cationic potato starch with DS 0.22 as cationic starch substance decreases turbidity of TMP efficiently compared to poly-DADMAC, polyamine and polyethyleneimine.

Fixation Test B: Using Coated Broke as Test Stock

Test stock in the fixation test B is a coated broke. Parameters of the coated broke, before any addition of fixation chemicals, are as follows:

Consistency: 19.6 g/l

Ash content of dry pulp: 5.1%

Zeta-potential: −12.8 mV

Conductivity: 2.0 mS/cm pH: 8.0

Charge density of the filtrate: −42 μeg/l

Turbidity of the filtrate: 94 NTU

Same test standards and devices are used as in Fixation Test 1.

The chemicals in the test are:

1. Commercial poly-DADMAC, same as in Fixation Test A
2. Commercial synthetic copolymer, used in Example 2, named "Polyamine"
3. Fixative composition 2, comprising both high cationic starch and synthetic cationic polymer named "FC2"

TABLE 8

Fixation test results for coated broke.

| Fixative chemical | Dosage, g/t pulp | Reduction of turbidity, % | Charge density increase, % |
|---|---|---|---|
| Polyamine | 100 | 40 | 29 |
| Polyamine | 200 | 57 | 39 |
| Polyamine | 400 | 69 | 47 |
| FC2 | 100 | 46 | 16 |
| FC2 | 200 | 61 | 13 |
| FC2 | 400 | 77 | 33 |
| p-DADMAC | 100 | 45 | 32 |
| p-DADMAC | 200 | 60 | 38 |
| p-DADMAC | 400 | 75 | 55 |

The results in Table 8 show that the Fixative Composition 2 ("FC2"), which contains high cationic potato starch with DS 0.22, as a cationic starch substance decreases turbidity of coated broke better than polyamine and at least as well as poly-DADMAC.

Example 5

Production of Fixative Composition 3 (FC3) Comprising High Cationic Starch and a Synthetic Cationic Polymer Conventional cationic potato starch, which has bound nitrogen content of 1.19%, i.e. having a degree of substitution, DS, 0.16, and dry substance content 83.0% is dissolved in water in a similar manner as the Fixative Composition 2 above. The starch solution is made by using 1518 g de-ionized water and 482 g starch.

The Fixative Composition 3 is obtained by mixing of 200 g of this starch solution and 119.5 g de-ionized water and 80.5 g commercial copolymer of epichlorohydrin and dimethylamine, crosslinked with ethylenediamine, which was also used for the Fixative Composition 2. The obtained solution of Fixative Composition 3 has dry substance content of 20.0%; viscosity of 590 mPas, measured with Brookfield DV I+−viscometer, equipped with SSA with spindle 18, rotation speed 6 rpm; and pH 5.3.

Fixation test C: Using Thermomechanical Pulp (TMP) as Test Stock

Test stock in the fixation test C is a thermomechanical pulp. Parameters of the thermo mechanical pulp, before any addition of fixation chemicals, are as follows:

Consistency: 21.8 g/l

Ash content of dry pulp: 1.25%

Zeta-potential: −15.5 mV

Conductivity: 3.33 mS/cm pH: 7.8

Charge density of the filtrate: −681.9 μeq/l

Turbidity of the filtrate: 269 NTU

Same test standards and devices are used as in Fixation Test 1.

The chemicals in the test are:

1. Commercial synthetic copolymer, used in Example 2, named "Polyamine"
2. Fixative composition 3, comprising both high cationic starch and synthetic cationic polymer named "FC3"

TABLE 9

Fixation test results for thermomechanical pulp.

| Fixative chemical | Dosage, g/t pulp | Reduction of turbidity, % | Charge density increase, % |
|---|---|---|---|
| FC3 | 200 | 30 | −5 |
| FC3 | 400 | 45 | 10 |
| FC3 | 800 | 73 | 18 |
| Polyamine | 200 | 12 | 3 |
| Polyamine | 400 | 24 | 12 |
| Polyamine | 800 | 47 | 18 |

The results in Table 9 show that the Fixative Composition 3 ("FC3"), which contains high cationic potato starch with DS 0.16 as a cationic starch substance decreases turbidity more efficiently than polyamine. The impact on charge density of the pulp is similar.

Even if the invention was described with reference to what at present seems to be the most practical and preferred embodiments, it is appreciated that the invention shall not be limited to the embodiments described above, but the invention is intended to cover also different modifications and equivalent technical solutions within the scope of the enclosed claims.

The invention claimed is:

1. A fixative composition for making of paper or board, suitable for reducing hydrophobic and/or anionic substances in fibre-containing stock, which fixative composition comprises 20-80 weight % of a synthetic cationic polymer, which has a charge density of 3.0-24 meq/g, and 20-80 weight % of a cationic non-degraded starch, which has a charge density of 0.5-3.0 meq/g the composition having a total charge density in the range of 2-8 meq/g.

2. Fixative composition according to claim 1, characterised in that it comprises 20-70 weight-% synthetic cationic polymer and 30-80 weight-% cationic non-degraded starch.

3. Fixative composition according to claim 2, characterised in that the fixative composition comprises 30-50 weight-% synthetic cationic polymer and 50-70 weight-% cationic non-degraded starch.

4. Fixative composition according to claim 1, characterised in that the synthetic cationic polymer is a copolymer of dialkylamine(s) and epichlorohydin, poly-DADMAC, polyethyleneimine or polyvinylamine.

5. Fixative composition according to claim 4, characterised in that the synthetic cationic polymer is a linear or cross-linked copolymer of dialkylamine(s) and epichlorohydrin, such as a copolymer of dimethylamine and/or diethylamine and epichlorohydrin.

6. Fixative composition according to claim 5, characterised in that the synthetic cationic polymer is a copolymer of dimethylamine and epichlorohydrin, cross-linked with ethylenediamine.

7. Fixative composition according to claim 1, characterised in that the synthetic cationic polymer has a charge density of 3-10 meq/g.

8. Fixative composition according to claim 1, characterised in that the synthetic cationic polymer has an average molecular weight, MW, in the range of 20 000-1 500 000 Dalton.

9. Fixative composition according to claim 1, characterised in that the cationic non-degraded starch has charge density of 0.6-2.5 meq/g.

10. Fixative composition according to claim 1, characterised in that the cationic non-degraded starch is modified solely by cationisation, it is non-degraded and non-cross-linked and of natural origin.

11. Fixative composition according to claim 1, characterised in that the cationic non-degraded starch has an amylopectin content >70%.

12. Fixative composition according to claim 1, characterised in that the cationic non-degraded starch has a degree of substitution, DS, from about 0.09 to 0.9.

13. Fixative composition according to claim 1, characterised in that in the cationic non-degraded starch at least 75 weight-% of the starch material has an average molecular weight (MW) over 30 000 000 Dalton.

14. Fixative composition according to claim 1, characterised in that the composition has a viscosity of 200-10 000 mPas measured at 23° C.

15. Fixative composition according to claim 1, characterised in that the synthetic cationic polymer has a charge density of 4-8 meq/g.

16. Fixative composition according to claim 1, characterised in that the cationic non-degraded starch has charge density of 0.7-2.0 meq/g.

* * * * *